US005083849A

United States Patent [19]

Crosby

[11] Patent Number: 5,083,849

[45] Date of Patent: Jan. 28, 1992

[54] LIGHT SIGNAL SAMPLING SYSTEM

[75] Inventor: Philip S. Crosby, Portland, Oreg.

[73] Assignee: Tektronix, Inc., Beaverton, Oreg.

[21] Appl. No.: 525,815

[22] Filed: May 18, 1990

[51] Int. Cl.[5] ..... G09G 1/04; H01J 31/48

[52] U.S. Cl. ..... 315/364; 315/11

[58] Field of Search ..... 315/364, 13.11, 13.1, 315/12.1, 11; 313/395, 541

[56] References Cited

U.S. PATENT DOCUMENTS

| | | | |
|---|---|---|---|
| 3,814,979 | 6/1974 | Eberhardt | 315/11 |
| 3,887,810 | 6/1975 | Skaggs | 315/11 |
| 3,955,117 | 5/1976 | Eberhardt | 315/11 |
| 4,677,341 | 6/1987 | Kinashita et al. | 315/12.1 |

*Primary Examiner*—Gregory C. Issing
*Attorney, Agent, or Firm*—Francis I. Gray; John P. Dellett

[57] ABSTRACT

A sampling streak oscilloscope responsive to a light input signal stores charges on a CCD target by means of an electron beam rapidly scanned across a narrow dimension of the CCD target in coincidence with a segment or portion of the light input signal. The time relationship between a streak and the light input signal is changed to record a charge pattern for another segment of the input signal, while charges representative of a prior segment are transferred along the CCD array. A representation of the entire input signal is built up in memory.

19 Claims, 2 Drawing Sheets

LIGHT SIGNAL SAMPLING SYSTEM

Background of the Invention

The present invention relates to a light signal responsive system and particularly to such a system adapted to sample repetitive occurrences of an input light signal.

A streak camera or streak oscilloscope is an instrument for converting light intensity variation to a scan in a cathode-ray-tube type instrument by modulating a beam of electrons with the light input. The intensity of the electron beam is recorded as it is scanned across a surface. In such an apparatus an incoming light signal may be optically focused upon a photocathode which emits the electron beam and this electron beam is then scanned along a target, suitably comprising phosphorus screen. The resulting "streak" image representing the entire input signal can be recorded on film or read out in a manner similar to that employed with a a television camera. The time resolution of existing streak cameras or streak oscilloscopes is limited by the speed of the sweep waveform employed to deflect the light-modulated electron beam along the target.

Sampling optical oscilloscopes offer improved time resolution for recording repetitive light signals, generally received from an optical fiber. However, the sampling rate is not as high as might be desired. Sampling oscilloscopes are special purpose instruments operating only in an equivalent-time mode and do not permit alternative real-time usage.

One streak camera or streak oscilloscope employs a specialized target structure for use in a sampling mode. In this case, the target contains a slit for receiving a light-modulated electron beam at an instant in time as the electron beam is deflected across the slit. The electrons passing through the slot are detected by an electron multiplier whereby a small signal can be amplified to produce a sample of the input. Unfortunately, only information regarding one small sample of the input is received at a given time for each scan of the electron beam and consequently many repetitions of the input signal are required in order to assemble a complete record. Thus, as in the case of existing sampling optical oscilloscopes, the sampling rate is not as high as would be desirable.

SUMMARY OF THE INVENTION

In accordance with the method and apparatus of the present invention, a repetitive light signal input is employed to modulate the intensity of an electron beam generated by a photocathode receiving the light input. The beam of electrons as generated by the photocathode is scanned rapidly across a CCD (charge coupled device) target in the relatively narrow Y dimension thereof, and more slowly along the X dimension. The result of the scan is the production of a narrow, substantially vertical or slightly diagonal, charge image across a column of CCD cells in the target. The deflection scanning is synchronous with the input signal and preferably the deflection signals are at a frequency equal to an integer submultiple of the repetition frequency of the input signal. After a number of scans, a column of cells or plural columns of cells across the CCD target will store information representing a plurality of samples for a short segment of the light input signal. Then, the stored samples are shifted along the CCD target (in the X direction thereof) and read out, after which the time relation between the X and Y scans and the light input signal is changed so that the deflected electron beam will represent another plurality of samples. The foregoing operation is continued until samples, as desired, of the complete input signal have been transferred from the CCD target and assembled in computer memory.

In a preferred scanning system, the deflection signal applied in the Y or vertical direction system comprises a square wave, while the deflection signal utilized in the horizontal or X direction suitably comprises a sine wave, both of which are synchronous with the repetitive light input signal. The axis crossings of the X and Y deflection signals are arranged to be nearly coincident, with the square wave executing its axis crossing slightly before the sine wave in such manner that the square wave, Y-axis deflection produces a rapid excursion of the electron beam across the CCD target. Inasmuch as the X and Y deflection signals are slightly staggered, a pair of charge patterns for different portions of the input signal are stored on the target. Thus, twice as many samples can be produced as compared with an operating mode where scanning takes place in only one direction across the target. Scanning crossways of a target, which is narrow in the direction of scanning, enhances rapid scanning, and the production of a comparatively large number of samples exhibiting enhanced time resolution.

It is accordingly an object of the present invention to provide an improved light signal sampling system characterized by improved time resolution.

It is another object of the present invention to provide an improved light signal sampling system having an increased sampling rate.

It is another object of the present invention to provide an improved light signal sampling system which can alternatively be employed in a real-time or conventional mode.

The subject matter of the present invention is particularly pointed out and distinctly claimed in the concluding portion of this specification. However, both the organization and method of operation, together with further advantages and objects thereof, may best be understood by reference to the following description taken in connection with accompanying drawings wherein like reference characters refer to like elements.

DRAWINGS

FIG. 1 is a schematic representation of a light signal sampling system according to the present invention, and FIG. 2 is a view of the CCD target as employed in the FIG. 1 system.

DETAILED DESCRIPTION

Figure 1:
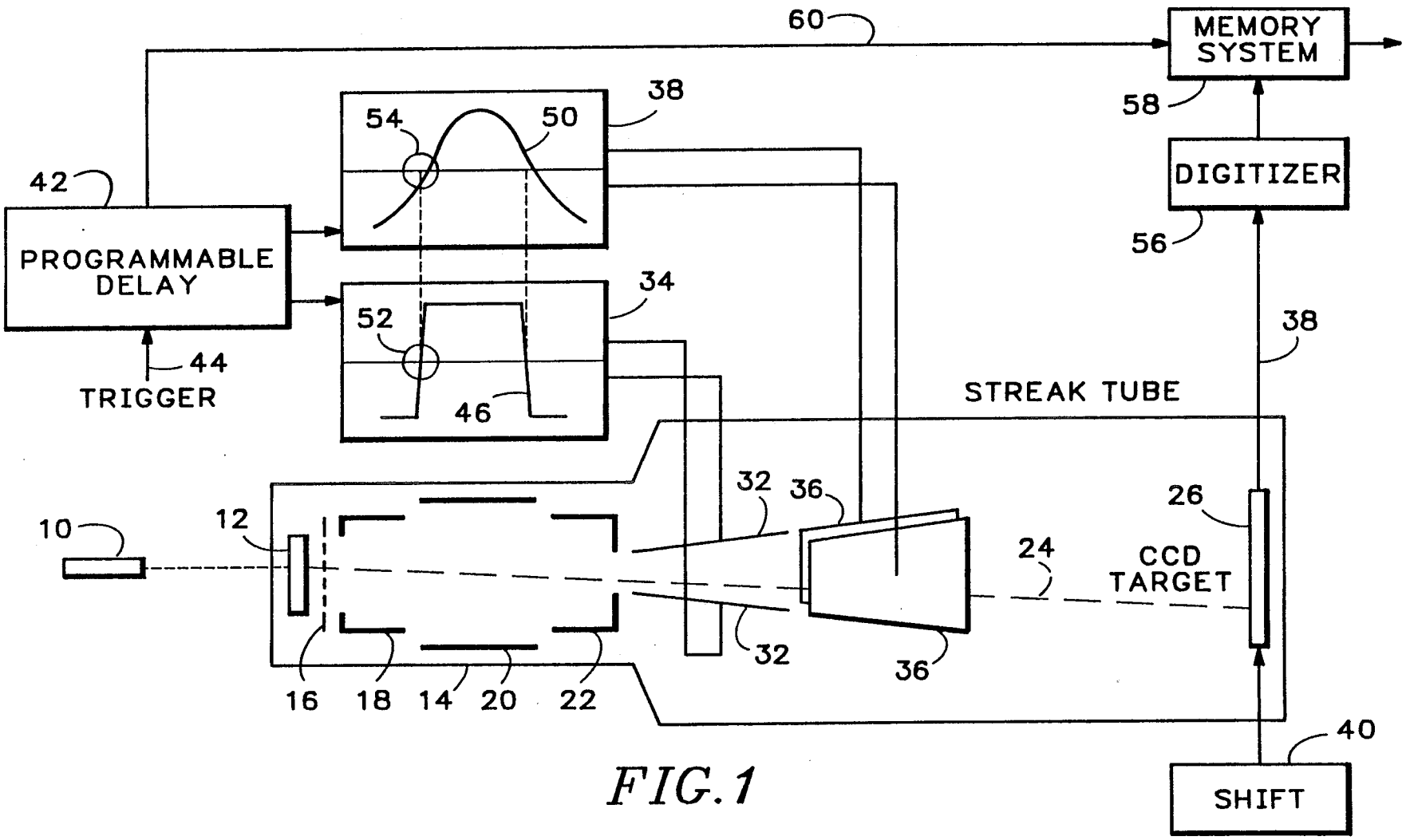

Referring to FIG. 1 illustrating apparatus according to an embodiment of the present invention, a repetitive light input signal from a light source 10 such as a laser is focused (by means not shown) onto photocathode 12 via the transparent end of a streak tube 14. Streak tube 14 is similar in construction to a conventional cathode-ray-tube, but substitutes photocathode 12 for the conventional thermionic cathode. The photocathode emits electrons in a manner responsive to the intensity of incident light from the light source. Assuming the light from light source 10 is focused to a small spot on the photocathode, such area will emit a comparatively narrow electron beam 24 having beam current proportional to the intensity of the light, the beam then passing through grid 16 to an electron lens including first anode 18, focusing electrode 20, and second anode 22 where the beam is focused to a small spot on target electrode 26.

Figure 2:
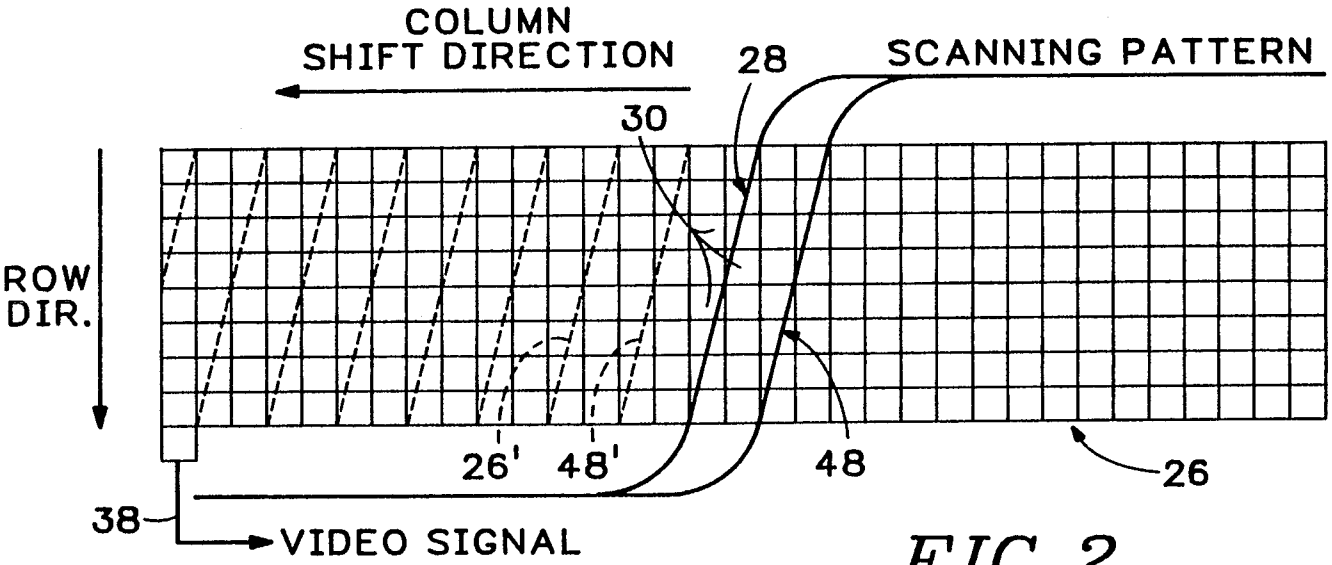

The target electrode 26 comprises a CCD (charge-coupled-device) target illustrated schematically in FIG. 2. The target comprises an array of CCD cells responsive to charge deposited by the electron beam for storage. Thus, if path 28 represents the scan of the electron beam across the target, charges will be sequentially "written" in CCD cells 30 along path 28, with the charge deposited in each cell representing the average intensity of the electron beam while the electron beam passes over such CCD cell. The CCD target as illustrated in FIG. 2 comprises a rectangular array of CCD cells, eight cells high (in the vertical direction) and thirty-three cells long (in the horizontal direction). However, the number of cells depicted in the drawing is for illustrative purposes only, and in a particular embodiment the CCD target array was sixty-four cells high (in the vertical direction) by 520 cells long (in the horizontal direction). It is desirable that the target have a long and narrow "aspect ratio" such that an electron beam 24 scanning the target in the vertical or Y direction will scan a shorter distance than it does in the horizontal or X direction as will hereinafter be more fully explained. The scanning of electron beam 24 is preferably accomplished by electrostatic scanning apparatus comprising vertical deflection plates 32 driven by vertical sweep generator 34, and horizontal deflection plates 36 driven by horizontal sweep generator 38.

The charge information stored along a path 28 on CCD target 26 is suitably the result of a plurality of identical scans across the target for building up charge. Successive passes may represent repetitions of a portion or segment of the light input signal, with which the X and Y deflection signals have a synchronous relation. Preferably, the X and Y deflection signals are equal in frequency to each other, said frequency being an integer submultiple of the repetition frequency of the light input signal. Although ideally the electron beam 24 would strike only one CCD cell 30 at a time, it will be appreciated by those skilled in the art that charges may be stored to some extent in adjacent cells parallel to path 28, dependent upon the degree of focus of the electron beam. The stored charges in cells along path 28 in FIG. 2 are subsequently shifted out of the CCD target in the X or horizontal direction and provide a video signal at 38 in response to operation of shift means 40 which causes the CCD array to function in the manner of an analog shift register as well understood by those skilled in the art.

As mentioned above, the vertical and horizontal deflection signals provided by sweep generators 34 and 38 have a synchronous relation with the repetitive input signal from light source 10, and in such case multiple passes along path 28 record and reinforce a representation of the same portion or segment of the input signal from the light source. Sweep generators 34 and 38 are both responsive to programmable delay circuit 42 receiving a trigger at 44 coincident with the input signal and which may be derived from the input signal source or other source having a synchronous relation with the input signal. In a preferred embodiment, vertical sweep generator 34 produces a "square" wave, while horizontal sweep generator 38 produces a sine wave, wherein these deflection signals cross their zero axes, or have their minimum deflection point, in nearly coincident relation with one another but with a definite gap between them.

As can be seen from the waveform representations superimposed upon the respective sweep generators in FIG. 1, zero crossings of the square wave desirably precede those of the sine wave by a small amount, e.g. by an amount less than 30°, along their X axes. Assuming both the square wave 46 and the sine wave 50 are initially negative going and start in synchronism with the trigger presented at 44, i.e., in coincidence with some point in the light input waveform, then at a subsequent time square wave 46 will be positive going as indicated within circle 52, and sine wave 50 will be coincidently positive going as indicated within circle 54. The resultant scanning pattern with respect to the target 26 is illustrated in FIG. 2 including paths 28 and 48 across the target in a nearly vertical or Y direction (or at a small angle with respect thereto), wherein the extremes of square wave 46 are at a voltage sufficient to carry the electron beam 24 beyond the target area. It will be seen the relatively slow horizontal scanning produced by sine wave 50 moves the electron beam from right to left and left to right in the X direction along the target 26 in FIG. 2, while square wave 46 causes the electron beam to scan rapidly up and down crossways of the target defining paths 28 and 48. Path 48 is traced when the respective square wave 46 and sine wave 50 are negative going near their zero axes.

If square wave 46 and sine wave 50 both have a frequency equaling half the repetition frequency of a repetitive light input signal, then scan 48 will represent a segment or portion of the input signal in the next repetition thereof. As can be seen, the slight staggering of the zero crossings of sweep waveforms 46 and 50 presents two separated paths 28 and 48 across the target, i.e., which are non-coincident and non-interfering in their horizontal or X positioning along the target 26. Twice as many samples are taken than in the case where scanning is only in one direction and blanking of the retrace beam is unnecessary.

While the term square wave is used in this specification, it will be appreciated that the deflection waveform is not necessarily completely square, i.e., having infinite vertical slope, but it is nonetheless relatively fast in its positive-to-negative and negative-to-positive excursions, as compared with sine wave 50, in order to produce deflection paths 28 and 48 which are substantially crossways of the target 26. Also, the slower waveform 50 applied to the horizontal plates need not be a sine wave, but the waveform is advantageously periodic, changing in an increasing and decreasing manner, so as to form a deflection or scanning pattern similar to the one depicted in FIG. 2. It is alternatively possible to substitute constant voltage values on horizontal deflection plates 36 whereby scanning pathway 28 across the narrow dimension of the target is substantially vertical but wherein the electron beam is blanked when it would otherwise execute a pathway 48 in response to the negative going portion of square wave 46. The square wave, sine wave combination is preferred because an increased number of samples are procured, and also for timing purposes.

In operation in accordance with the present invention, scanning of electron beam 24 is accomplished in substantial synchronism with the light input signal in the manner hereinbefore described, wherein the input signal according to preferred operation is assumed to be repetitive. Both X and Y deflection signals are maintained in a given time relationship with the light input signal via trigger 44 until a plurality of deflection paths 28 and 48 are executed across the target to build up charge patterns along these paths each representative of a small portion or segment of the light input signal. After build up of a suitable charge pattern, the beam 24 is prevented from impinging upon target 26, for example by control via grid 16 or by temporarily defecting the beam 24 entirely away from the target by means of a further voltage applied to the vertical plates. Programmable delay circuit 42 is then controlled so that a slightly different time relationship will exist between trigger 44 and the generation of waveforms 46 and 50, e.g., the generation of the latter waveforms is delayed slightly in respect to their synchronism with the input trigger. The signal charges in all of the target columns, i.e., in adjacent CCD cells crossways of the target, are shifted to the left in FIG. 2, operating the CCD cell array as an analog shift register in a conventional manner. That is, the charge patterns theretofore coincident with scanning paths 28 and 48 are shifted to the left, for example to positions indicated at 28' and 48', so that "fresh" CCD cells are under the normal beam paths 28 and 48.

Since the delay time interval between the signal trigger and the applied X and Y waveforms has now been changed, when the beam is then allowed to impinge on the target a new segment of the input light signal will modulate the electron beam as it is deflected along paths 28 and 48. By successively shifting charge patterns along the X direction of the CCD array, and successively delaying the initiation of the X and Y deflection signals relative to the light input signal, successive portions or segments representative of the intensity of the input light signal are sampled and moved along the array whereby further samples may be obtained. The scanning delay is suitably controlled so that samples are taken for adjacent or slightly overlapping waveform segments.

The charges at the leftmost column of the CCD array in FIG. 2 are read out as shifting occurs, the analog values thereof being applied to analog-to-digital converter or digitizer 56 in FIG. 1. The digitizer provides a digital value for a charge sample on each cell as shifted out, and such digital values are stored in memory system 58 together with an input 60 representing the corresponding time between the trigger point and the deflection waveforms, delayed by a factor corresponding to the time difference between the time the charges were "input" to the CCD array and the time they were read out of the CCD array. Sampling is desirably continued until the entire signal of interest has been sampled. A representation comprising a multiplicity of sample values is built up in memory system 58 that is assembled in accordance with the times the samples were taken in accordance with conventional digital techniques. The output of the memory system can be read out as desired for recreating a complete representation of the light input signal versus time.

Providing rapid sweep in response to operation of the vertical sweep generator 34 in a direction across the narrow dimension of the target advantageously enhances the sampling speed and consequent time resolution. To assist the production of a rapid vertical sweep, vertical deflection plates 32 are suitably closely spaced (more closely spaced than the horizontal plates) for having maximum effect on electron beam 24 in response to the square wave 46 supplied by vertical sweep generator 34. This is possible since the target is narrow in the vertical direction. A high sampling rate is provided since an appreciable number of signal samples (rather than only one or a few samples) are supplied across the target 26 after a given number of repetitions of the input signal to build up charges representing a segment of the input signal.

The apparatus in accordance with the present invention can also be employed in a non-sampling mode as a conventional streak oscilloscope. Thus, deflection can be provided only in the horizontal or X direction if desired during the occurrence of a light input signal, and the resultant charge pattern can be continuously read out. In such instance, a ramp waveform is suitably applied to the horizontal deflection plates 36 rather than sine wave 50. The streak oscilloscope can thus be operated in a real-time mode.

As will also be appreciated by those skilled in the art, multiple light input signals can be imaged on the same photocathode 12 and separate electron beams 24 will be generated for each light input. Multiple input channels can therefore be accommodated in either a sampling or real-time mode.

Use of the terms "horizontal" and "vertical" herein is not intended to mean only one possible physical orientation. In other words, these terms may be interchanged in describing the invention.

While a preferred embodiment of the present invention has been shown and described, it will be apparent to those skilled in the art that many changes and modifications may be made without departing from the invention in its broader aspects. The appended claims are therefore intended to cover all such changes and modifications as fall within the true spirit and scope of the invention.

I claim:

1. A light signal sampling system comprising:

imaging means including a photocathode which emits a beam of electrons in response to incident light input, a target having an array of writable cells extending in two dimensions and located at a distance from said photocathode, and means for focusing said beam of electrons on said target;

first deflection means for deflecting said beam of electrons in a first direction along said array;

second deflection means for deflecting said beam of electrons in a second direction across said array at a faster rate than provided by said first deflection means at a time when said beam is responsive to a given portion of said incident light input for the purpose of storing charges representing said given portion of said incident light input in cells across said array;

means for delaying the time of deflection of said beam of electrons in said second direction relative to occurrence of said incident light input after said storage so that the last mentioned deflection then occurs coincident with another portion of said incident light input; and means for transferring said charges from said array.

2. The system according to claim 1 further including memory means for receiving and assembling successive signals from said transferring means, each successive signal representing a different portion of said incident light input.

3. A light signal sampling system comprising:

imaging means including a photocathode which emits a beam of electrons in response to incident light input, a target having an array of writable cells extending in two dimensions and located at a distance from said photocathode, and means for focusing said beam of electrons on said target;

first deflection means for deflecting said beam of electrons in a first direction along said array responsive to a sine wave having a synchronous relation with said incident light input;

second deflection means for deflecting said beam of electrons in a second direction across said array responsive to a square wave having a synchronous relation with said incident light input at a faster rate than provided by the first deflection means at a time when said beam is responsive to a given portion of said incident light input for the purpose of storing charges representing said given portion of said incident light input in cells across said array; and means for transferring said charges from said array.

4. The system according to claim 3 wherein said sine wave and said square wave cross their zero axes at nearly the same time whereby the most rapidly changing portions of said sine wave and said square wave occur nearly simultaneously as said beam of electrons is deflected across said array.

5. The system according to claim 4 wherein zero axis crossings of said square wave are offset from those of said sine wave to provide a predetermined phase difference.

6. The system according to claim 5 wherein said charge storage occurs in response to both positive and negative deflection directions of said beam across said array as brought about by said square wave.

7. The system according to claim 3 wherein the dimensions of said array and the number of cells in said first direction along said array is substantially greater than the dimension and number of cells across said array in said second direction.

8. A light signal sampling system comprising:

imaging means including a photocathode which emits a beam of electrons in response to incident light input, a target comprising an array of writable cells extending in two dimensions and located at a distance from said photocathode, and means for focusing said beam of electrons on said target, means for deflecting said beam of electrons in a path across said array during the occurrence of a given portion of the incident light input, the beam current being responsive to said given portion of incident light input for the purpose of storing charges representing said portion of incident light input in cells across said array in a first direction, and means for transferring said charges between cells in a second direction along said array out of said path to allow for storage of further charges representing a further portion of said incident light input in cells in said path across said array.

9. A light signal sampling system comprising:

imaging means including a photocathode which emits a beam of electrons in response to incident light input, a target having an array of writable cells extending in two dimensions and located at a distance from said photocathode, and means for focusing said beam of electrons on said target;

means for deflecting said beam of electrons in a path across said array during the occurrence of a given portion of said incident light input, said beam being responsive to said given portion of said incident light input for the purpose of storing charges representing said portion of said incident light input in cells across said array in a first direction;

means for transferring said charges between cells in a second direction along said array out of said path to allow for storage of further charges representing a further portion of said incident light input in cells in said path across said array; and means for delaying the time of deflection of said beam of electrons relative to the occurrence of said incident light input after said transfer of charges along said array so that deflection then occurs coincident with said further portion of said incident light input.

10. A light signal sampling method comprising:

employing a light signal to modulate an electron beam, directing said electron beam toward a target capable of receiving a charge pattern from said beam, deflecting said electron beam in a path cross-ways of said target while said beam is responsive to a portion of said signal to provide a charge pattern on said target, said deflection being synchronous with the occurrence of said signal, delaying the time relationship between initiation of the time of deflection and said signal, as well as shifting the position of the charge pattern on said target out of the path of said beam so that a different portion of said signal then present during said deflection establishes a charge pattern on said target along said path, and reading out said target.

11. The method according to claim 10 wherein the position of the charge pattern provided across said target by the path of said electron beam, as well as said delay in said time relationship, repetitively provides plural charge patterns across said target for plural portions of said signal.

12. The method according to claim 11 wherein said shifting is accomplished by transferring charge patterns along said target in a direction generally orthogonal to said deflection.

13. The method according to claim 10 wherein said beam is deflected a number of times while said beam is responsive to the first mentioned portion of said signal to accumulate charge before said time relationship and positioning are delayed and shifted, respectively.

14. In a streak oscilloscope including a photocathode which emits a beam of electrons in response to incident light input, a target comprising an array of writable cells extending in two dimensions and located at a distance from said photocathode, and means for focusing said beam of electrons on said target, a method comprising:

deflecting said beam of electrons in a first direction across said target at a time during the occurrence of a given portion of the incident light input, the beam current being responsive to said given portion of incident light input for storing charges representing said portion of incident light input in a path across said array, shifting said charges in a second direction primarily transverse to said path for read out purposes, again deflecting said beam of electrons across said target at a time when said beam current is responsive to a second portion of said incident light input in order to store further charges representing said second portion of incident light input in the path across said array, and shifting said further charges in the second direction for reading out said further charges in sequential relation to reading out of the first mentioned charges.

15. In a streak oscilloscope including a photocathode which emits a beam of electrons in response to incident light input, a target having an array of writable cells extending in two dimensions and located at a distance from said photocathode, and means for focusing said beam of electrons on said target, a method comprising:

deflecting said beam of electrons in a first direction across said target at a time during the occurrence of a given portion of said incident light input, said beam being responsive to said given portion of said incident light input for storing charges representing said portion of said incident light input in a path across said array, the deflecting across said target being accomplished in response to a substantially square wave signal;

shifting said charges in a second direction primarily transverse to said path for read out purposes;

again deflecting said beam of electrons across said target in response to the substantially square wave signal at a time when said beam is responsive to a second portion of said incident light input in order to store further charges representing said second portion of said incident light input in the path across the array; and shifting said further charges in the second direction for reading out said further charges in sequential relation to reading out of the first mentioned charges.

16. The method according to claim 15 further including reading out said charges, digitizing values thereof, and storing said values in memory.

17. The method according to claim 15 including simultaneously deflecting said electron beam along said array with a sine wave signal.

18. The method according to claim 17 wherein rapid excursions of said square wave and sine wave signals near the median axes thereof are arranged to be nearly coincident, but offset from one another by a predetermined phase difference.

19. The method according to claim 15 including deflecting said beam of electrons in a direction across said target at a time when said beam is responsive to said given portion of said incident light input, in synchronism with repetitions of said incident light input, a number of times before shifting said charges for reading out.

* * * * *